US011612988B2

(12) United States Patent
Wu

(10) Patent No.: US 11,612,988 B2
(45) Date of Patent: Mar. 28, 2023

(54) ADJUSTABLE WRENCH USING COLORS FOR IDENTIFICATION

(71) Applicant: MATATAKITOYO TOOL CO., LTD., Taichung (TW)

(72) Inventor: Yi-Min Wu, Taichung (TW)

(73) Assignee: MATATAKITOYO TOOL CO., LTD., Taichung (TW)

( * ) Notice: Subject to any disclaimer, the term of this patent is extended or adjusted under 35 U.S.C. 154(b) by 198 days.

(21) Appl. No.: 17/315,358

(22) Filed: May 10, 2021

(65) Prior Publication Data

US 2022/0355444 A1 Nov. 10, 2022

(51) Int. Cl.

| | |
|---|---|
| ***B25B 13/14*** | (2006.01) |
| ***B25G 3/26*** | (2006.01) |
| ***B25B 23/142*** | (2006.01) |
| ***B25B 13/50*** | (2006.01) |

(52) U.S. Cl.

CPC ..... *B25B 13/14* (2013.01); *B25B 13/5058* (2013.01); *B25B 23/1427* (2013.01); *B25G 3/26* (2013.01)

(58) Field of Classification Search

CPC ..... B25B 13/12; B25B 13/14; B25B 13/16; B25B 13/18; B25B 13/5058; B25B 23/1427

See application file for complete search history.

(56) References Cited

U.S. PATENT DOCUMENTS

| | | | | |
|---|---|---|---|---|
| 4,982,627 | A | 1/1991 | Johnson | |
| 5,697,166 | A * | 12/1997 | Hommel | G01B 3/18 7/164 |
| 6,393,950 | B1 * | 5/2002 | Crosser | B25B 13/56 81/177.1 |
| 6,792,831 | B2 * | 9/2004 | Crosser | B25B 13/56 81/166 |
| 9,616,553 | B2 * | 4/2017 | Marovets | B25B 13/08 |
| 10,406,657 | B2 * | 9/2019 | Marovets | B25B 13/08 |
| 2015/0352696 | A1 * | 12/2015 | Wang | B25B 13/46 81/58.2 |

FOREIGN PATENT DOCUMENTS

| | | |
|---|---|---|
| CN | 2118617 U | 10/1992 |

* cited by examiner

*Primary Examiner* — David B. Thomas

(74) *Attorney, Agent, or Firm* — Bruce Stone LLP; Joseph A. Bruce

(57) ABSTRACT

An adjustable wrench uses colors for identification. The adjustable wrench includes a bit including multiple identification zones and a pointer in addition to a body and a movable jaw. The body includes a stationary jaw extending from a front end. The movable jaw is movably connected to the front end of the body so that a distance between the jaws is adjustable. The identification zones are formed on a side of the body. Each of the identification zones is in a color corresponding to a size of a workpiece. The pointer is formed on a side of the movable jaw. The distance between the jaws is set to be a value corresponding to the size of the workpiece when the pointer is aligned with one of the identification zones.

11 Claims, 10 Drawing Sheets

ADJUSTABLE WRENCH USING COLORS FOR IDENTIFICATION

BACKGROUND OF INVENTION

1. Field of Invention

The present invention relates to an adjustable wrench and, more particularly, to an adjustable wrench using colors for identification.

2. Related Prior Art

There are various tools such as box-ended wrenches, open-ended wrenches, adjustable wrenches, Allen keys, socket wrenches and related components. Pressing or printing is often used to provide a tool with an inscription to show a trademark, an aesthetic pattern or the size of the tool.

The use of the above-mentioned processes to make the inscription is not without any problem particularly where the inscription is used to show the size of the tool. For example, a user may have to wipe grease from the tool to read the inscription to know the size of the tool for the inscription is often covered entirely or partially by grease. Moreover, the user may have to flip the tool over to read the inscription since the inscription is often provided on a lower face of the tool in an operative position.

U.S. Pat. No. 4,982,627 discloses a tool-identifying system in which a color chart shows a range of ten colors and each color indicates a particular numeral. A sequence of indicated numerals represents the value of the size of a tool, in fractional inch or metric size. However, a user has to memorize the correspondence of the colors to the numerals. The user will experience troubles in picking bits of the right sizes might if he or she forgets the correspondence. Accordingly, the user may bring bits of wrong sizes to a working site and fail a task. Alternatively, the user may be forced to bring bits of all sizes to the working site, and this is quite a burden. In operation, the user may pick bits of wrong sizes before getting the bit of the right size, and this is a waste of time.

CN 2118617 discloses an adjustable wrench including a handle, a jaw formed on the handle, another jaw movably connected to the handle, a scale in fractional inch, and another scale in metric size. Each scale provides the correspondence of the value of each size to an actual with of a gap between the jaws. However, the scales could be covered with grease or steins.

Moreover, no wrench has been provided with anything to let a user know an adequate value of torque to be imposed on a workpiece such as a nut and a threaded bolt without causing damages to the workpiece. Hence, the user might not exert an inadequate value of torque to engage a nut with a threaded bolt so that the nut could easily be disengaged from the threaded bolt because of vibration.

The present invention is therefore intended to obviate or at least alleviate the problems encountered in the prior art.

SUMMARY OF INVENTION

It is the primary objective of the present invention to provide an adjustable wrench using colors for identification.

To achieve the foregoing objective, a bit of an adjustable wrench includes multiple identification zones and a pointer in addition to a body and a movable jaw. The body includes a stationary jaw extending from a front end. The movable jaw is movably connected to the front end of the body so that a distance between the jaws is adjustable. The identification zones are formed on a side of the body. Each of the identification zones is in a color corresponding to a size of a workpiece. The pointer is formed on a side of the movable jaw. The distance between the jaws is set to be a value corresponding to the size of the workpiece when the pointer is aligned with one of the identification zones.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
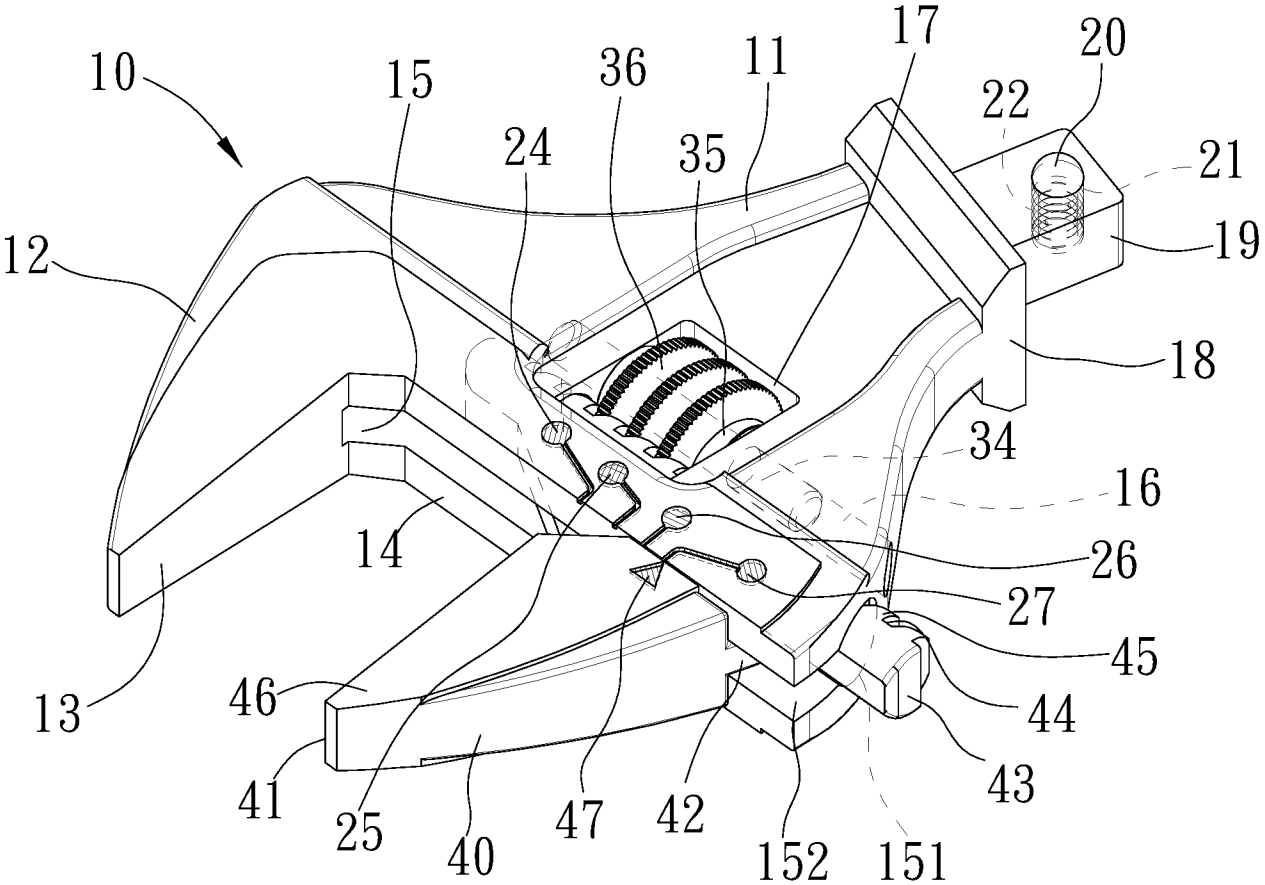
FIG. 1 is a perspective view of a bit of an adjustable wrench according to the first embodiment of the present invention.
Figure 7:
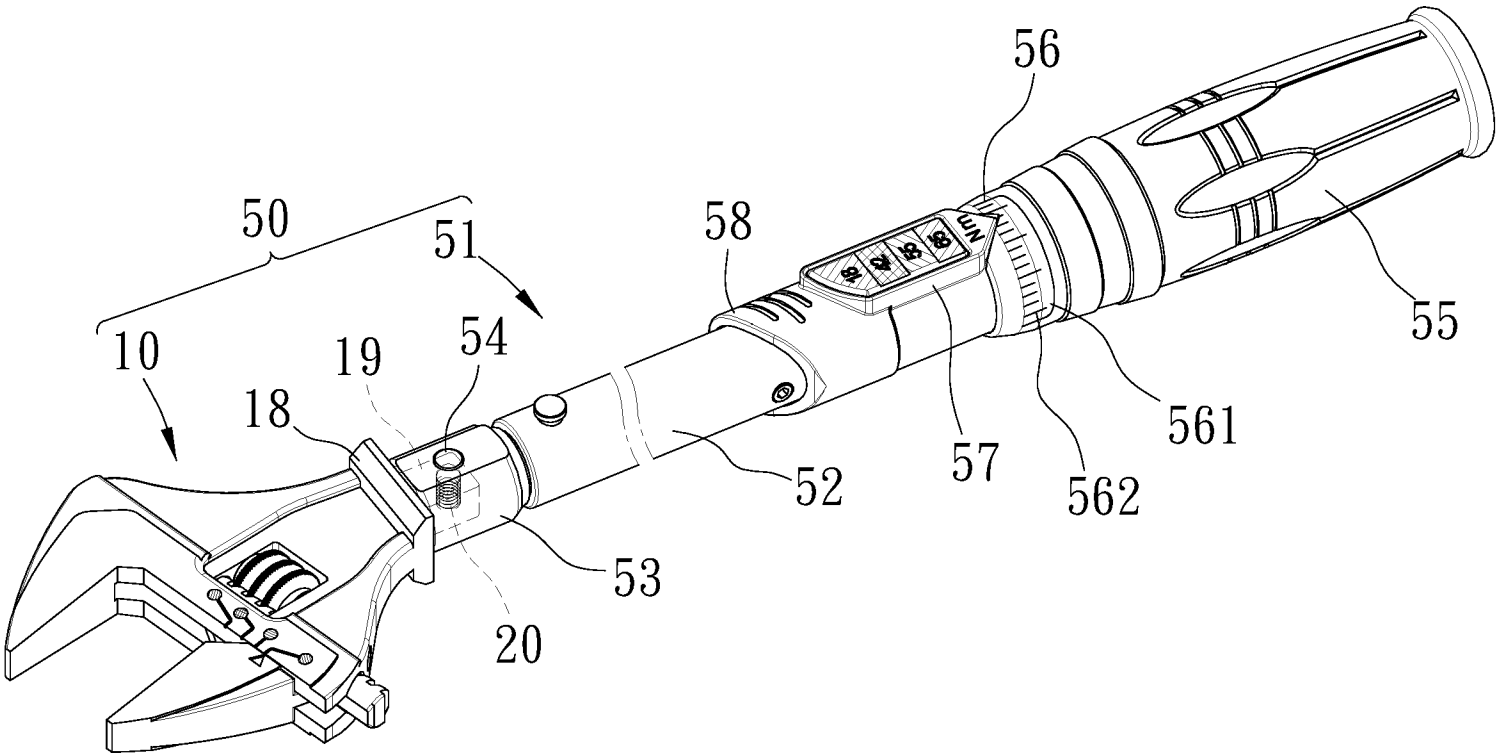
FIG. 7 is a perspective view of a handle connected to the bit shown in FIG. 1.

Referring to FIGS. 1 and 7, an adjustable wrench 50 consists of a handle 51 and a bit 10 according to a first embodiment of the present invention. The bit 10 includes a body 11, four identification zones 24 through 27, a worm, a movable jaw 40 and a pointer 47.

The body 11 that is formed with adequate rigidity and hardness includes a front end 14 and a rear end 18. An insert 19 extends from the rear end 18. The insert 19 is formed with a hole 21 to receive a ball 20 and a spring 22 that is compressed between the ball 20 and a closed end of the hole 21. The spring 22 presses a first portion of the ball 20 so that a second portion of the ball 20 sticks from the insert 19. The hole 21 is made with a reduced open end to keep the first portion of the ball 20 in the hole 21. The spring 22 is further compressed by the first portion of the ball 20 as the second portion of the ball 20 is located in the hole 21.

A stationary jaw 12 extends from the front end 14. The stationary jaw 12 and the front end 14 are made in one piece. The stationary jaw 12 is formed with a contact face 13.

The front end 14 is formed with a groove 15. The groove 15 consists of a cylindrical space 151 and a slot 152, i.e., the cylindrical space 151 and the slot 152 are in communication with each other. The groove 15 extends perpendicular to a plane in which the contact face 13 lies. The cylindrical space 151 extends throughout the body 11, i.e., the cylindrical space 151 includes two open ends. The slot 152 extends parallel to the cylindrical space 151.

Figure 10:
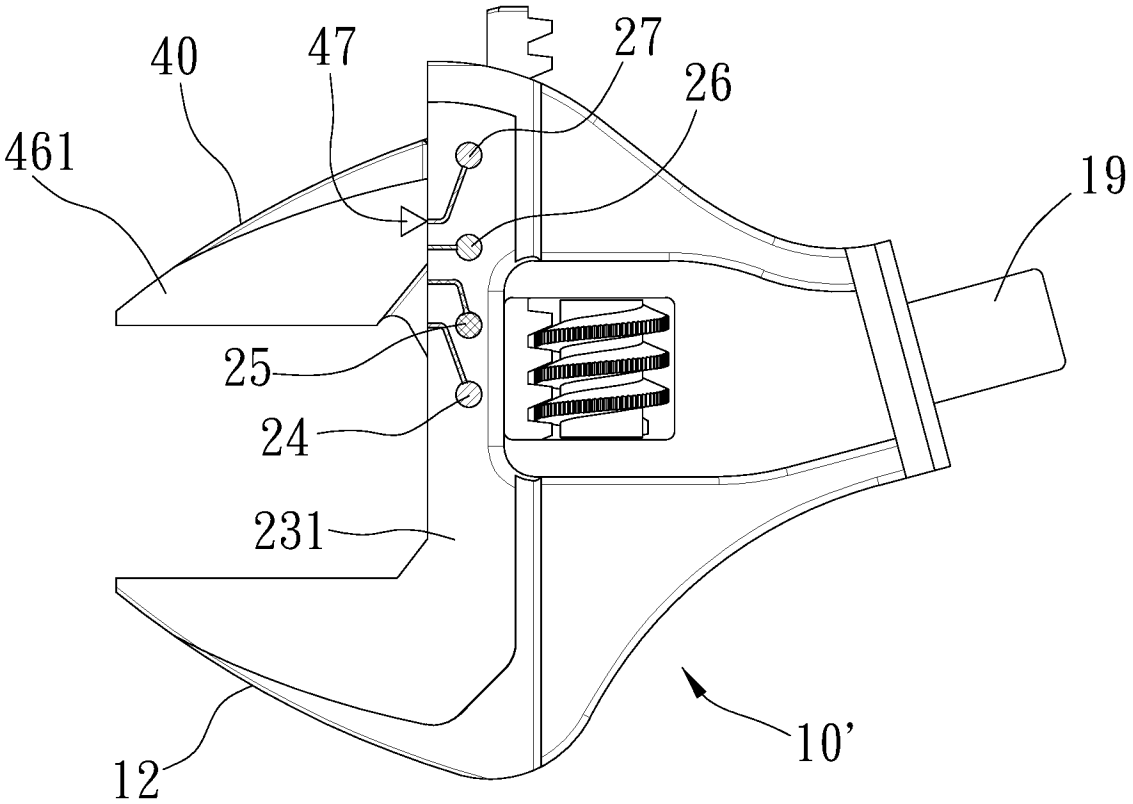
FIG. 10 is a side view of a bit of an adjustable wrench according to the second embodiment of the present invention.

The movable jaw 40 that is formed with adequate rigidity and hardness includes a connective portion 42 extending from a rear end and a rack 43 extending along the connective portion 42. Valleys 44 and teeth 45 are alternately arranged along a face of the rack 43. The rack 43 is movable along the cylindrical space 151 while the connective portion 42 is movable along the slot 152 so that the movable jaw 40 is movable relative to the stationary jaw 12 along the front end 14. The movable jaw 40 includes a contact face 41 pointed at the contact face 13 of the stationary jaw 12. The rack 43 is formed with a diameter larger than the breadth of the slot 152 so that rack 43 cannot be moved from the cylindrical space 151 via the slot 152. Thus, the movable jaw 40 is kept movable on the body 11. Moreover, the movable jaw 40 is formed with two opposite sides 46 and 461 (FIG. 10).

Figure 2:
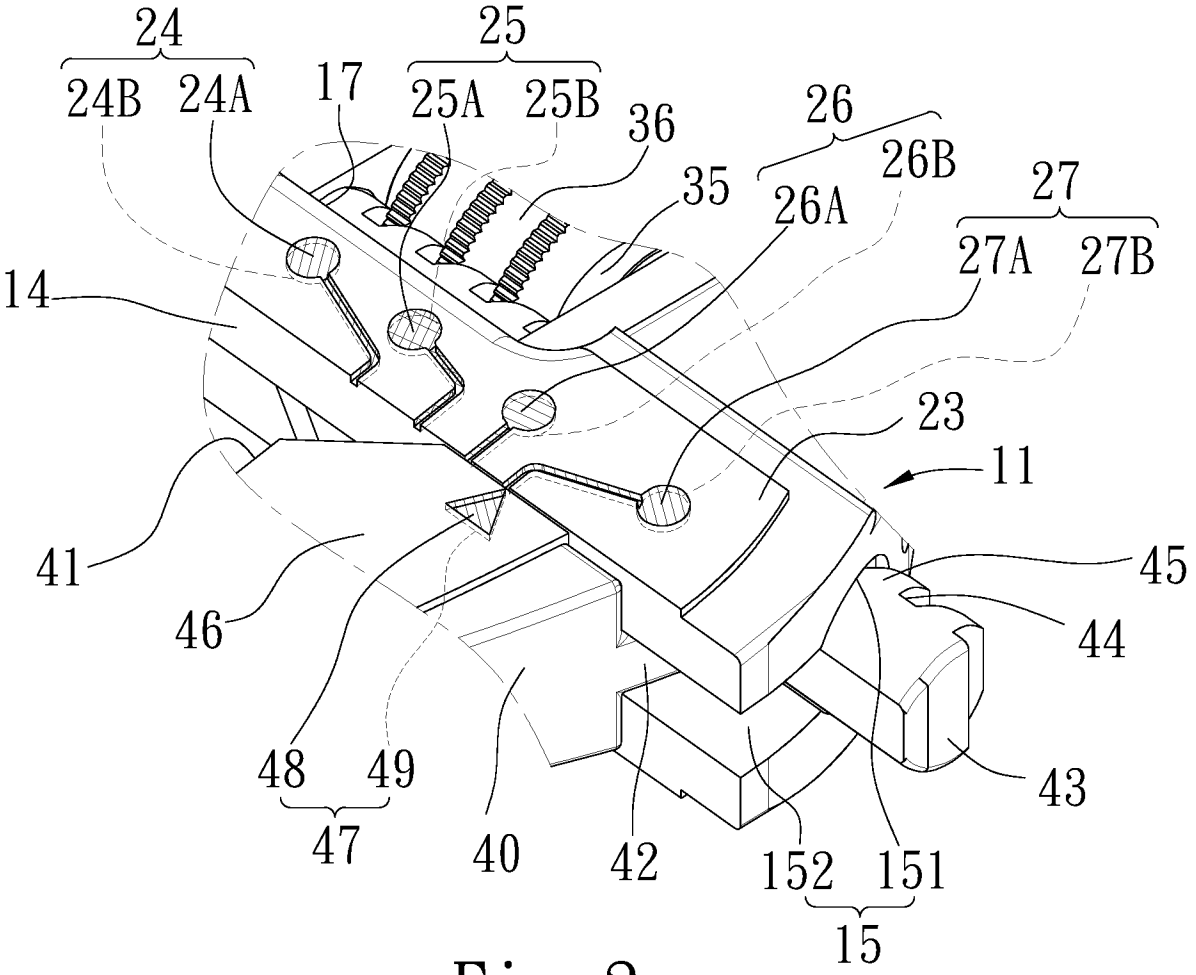
FIG. 2 is an enlarged partial view of the bit shown in FIG. 1.
Figure 9:
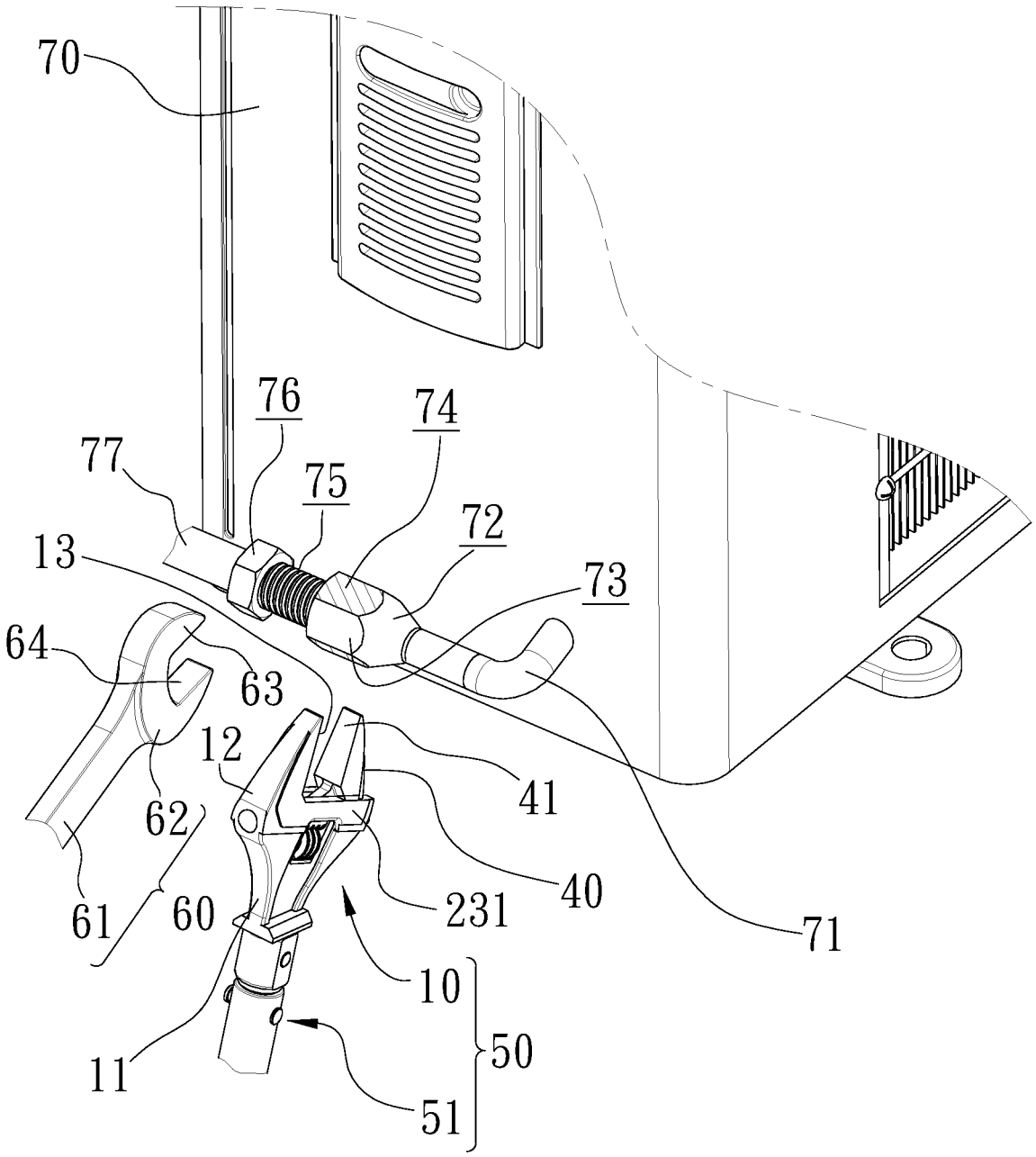
FIG. 9 is a perspective view of a nut engaged with a threaded bolt by an open-ended wrench and the adjustable wrench shown in FIG. 7.

Referring to FIGS. 2 and 9, the body 11 includes two sides 23 and 231. The body 11 includes a bore 16 and an opening 17. The opening 17 includes an open end in the side 23 and another open end in the side 231. The opening 17 is located between two sections of the bore 16. The opening 17 is in communication with the cylindrical space 151.

The worm includes an axle 34, a cylinder 35 and a helical portion 36. The cylinder 35 is inserted in the opening 17. The axle 34 is inserted in the bore 16. The axle 34 includes a section fitted in the cylinder 35 so that the axle 34 and the cylinder 35 are rotatable together. The helical portion 36 extends on the cylinder 35. The helical portion 36 is engaged with some of the teeth 45 that are located in the opening 17.

The identification zones 24 to 27 are located on the side 23 of the body 11. The identification zones 24 to 27 are in different colors corresponding to various sizes of workpieces to be rotated by the adjustable wrench 50. The workpieces are nuts or threaded bolts for example.

The identification zone 24 includes a colored layer 24A located in a recess 24B made in the side 23 of the body 11. The identification zone 25 includes a colored layer 25A inserted in a recess 25B made in the side 23 of the body 11. The identification zone 26 includes a colored layer 26A located in a recess 26B made in the side 23 of the body 11. The identification zone 27 includes a colored layer 27A inserted in a recess 27B made in the side 23 of the body 11. The colored layers 24A, 25A, 26A and 27A are in different colors. Each of the recesses 24B, 25B, 26B and 27B includes a first portion in the form of a narrow groove and a second portion in the form of a circular bore. Thus, each of the identification zones 24 to 27 includes a first portion in the form of a line corresponding to the narrow groove and a second portion in the form of a circle corresponding to the circular bore.

The identification zones 24 to 27 are given as an example. There can be any other proper number of identification zones, or the identical zones 24 to 27 can be in any other proper shape.

The pointer 47 is located on the side 46 of the movable jaw 40 corresponding to the identification zones 24 through 27. The pointer 47 includes a colored layer 48 located in a recess 49 made in the side 46 of the movable jaw 40. The recess 49 is in the form of an equilateral or isosceles triangle, with a corner pointed at the front end 14 of the bit 10. However, the pointer 47 can be in any other proper shape.

The pointer 47 is aligned with one of the identification zones 24 to 27 so that the distance between the contact faces 41 and 13 is set at a value corresponding to one of the sizes of the workpieces. Thus, the adjustment of the value of the distance between the contact faces 41 and 13 is easy, without having to memorize, calculate or experience a trial-and-error process.

As follows, a table is given to illustrate a relationship between the identification zones, the sizes of the workpieces (mm) and proper values of torque (Nm) to be exerted on the workpieces.

| IDENTIFICATION ZONE | SIZE OF WORKPIECE (MM) | VALUE OF TORQUE (NM) |
|---|---|---|
| IDENTIFICATION ZONE 24 | 17 | 18 |
| IDENTIFICATION ZONE 25 | 22 | 42 |
| IDENTIFICATION ZONE 26 | 26 | 55 |
| IDENTIFICATION ZONE 27 | 29 | 65 |

In use, the helical portion 36 is rotated to translate the rack 43 due to the engagement of some of the teeth 45 with the helical portion 36.

The movable jaw 40 is translated because the movable jaw 40, the connective portion 42 and the rack 43 are made in one piece. Thus, the distance of the movable jaw 40 from the stationary jaw 12 is adjusted.

Figure 3:
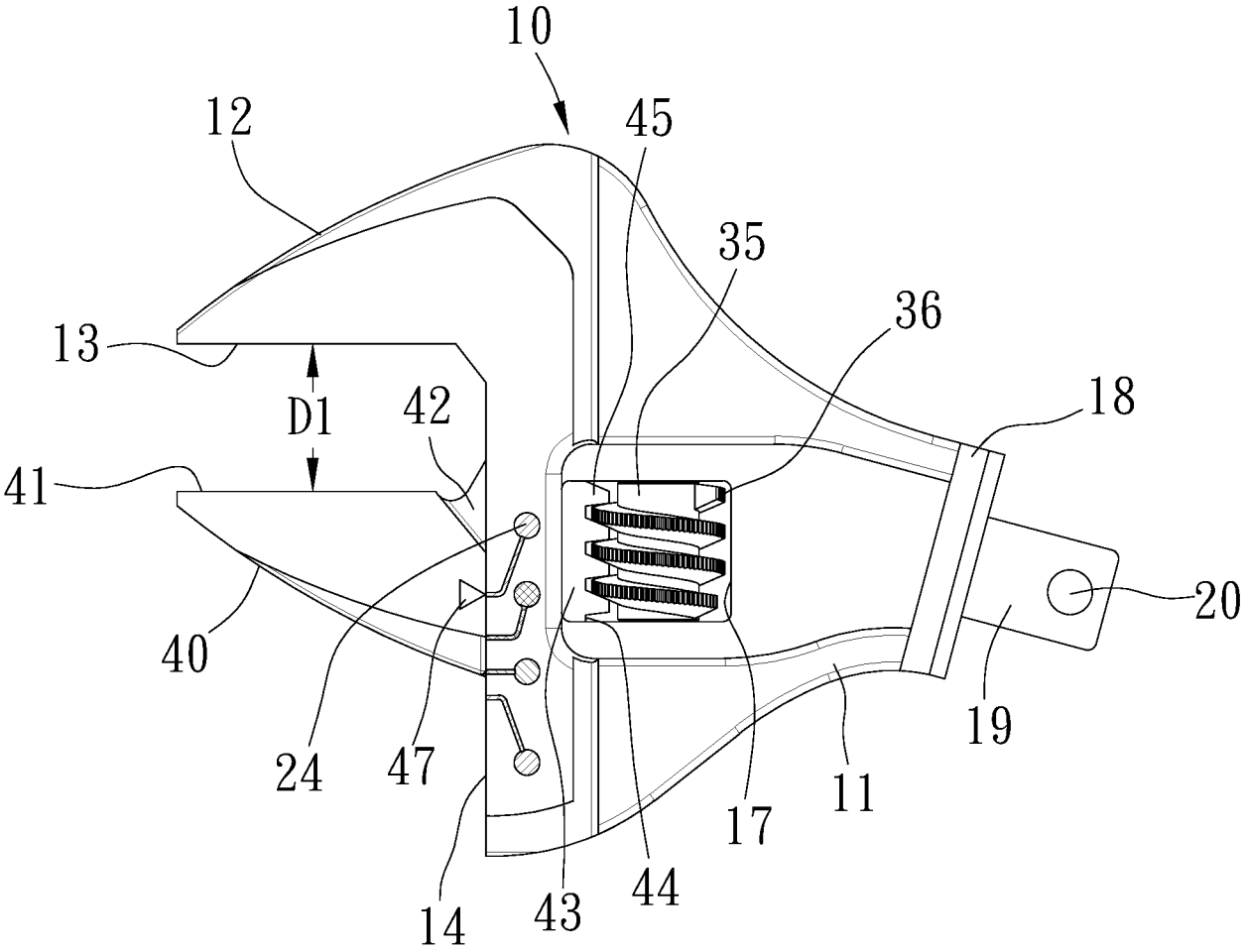
FIGS. 3 through 6 are side views of the bit shown in FIG. 1.

Referring to FIG. 3, the distance between the contact faces 41 and 13 is D1 when the pointer 47 is aligned with the identification zone 24. D1 is 17 mm for example.

Figure 4:
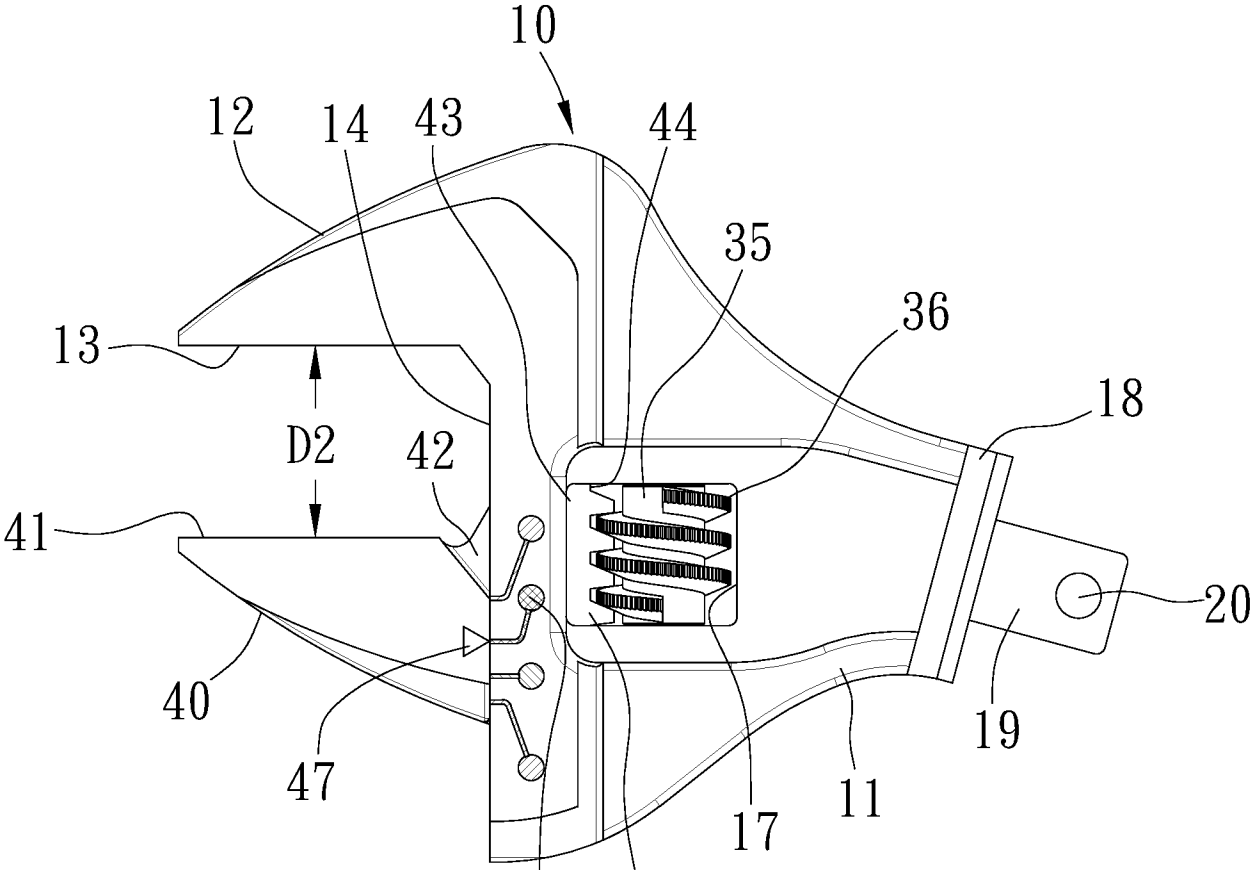

Referring to FIG. 4, the distance between the contact faces 41 and 13 is D2 when the pointer 47 is aligned with the identification zone 25. D2 is 22 mm for example.

Figure 5:
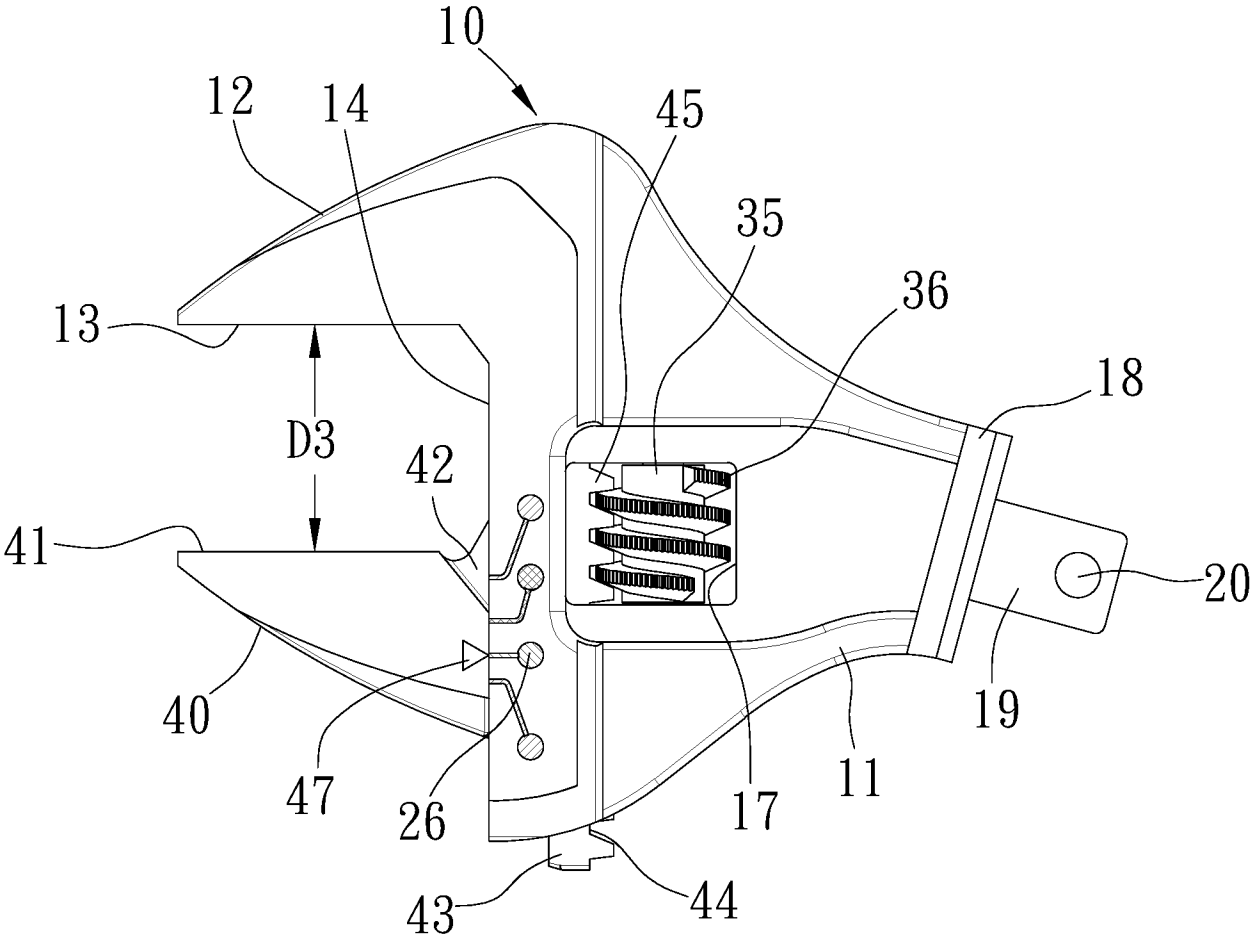

Referring to FIG. 5, the distance between the contact faces 41 and 13 is D3 when the pointer 47 is aligned with the identification zone 24. D3 is 26 mm for example.

Figure 6:
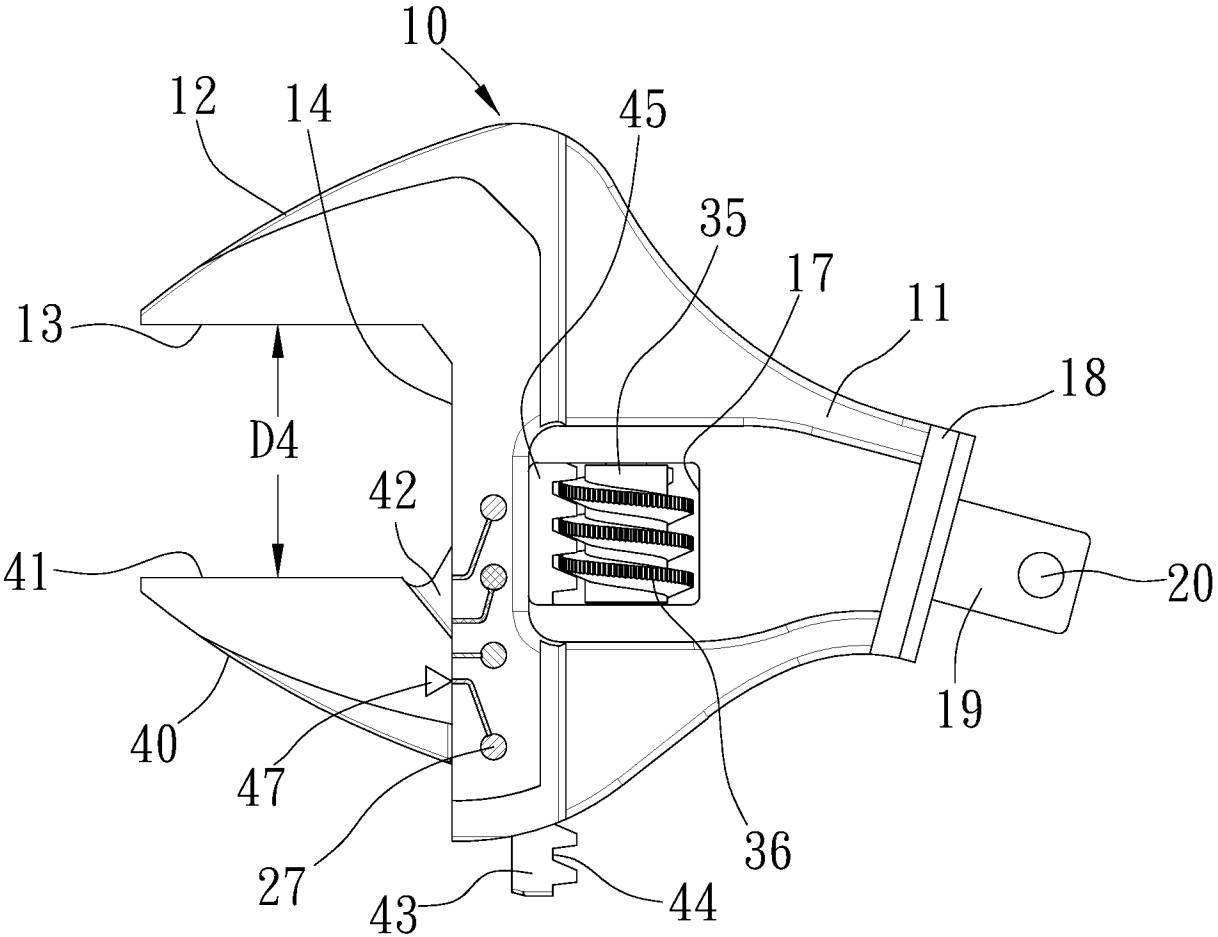

Referring to FIG. 6, the distance between the contact faces 41 and 13 is D4 when the pointer 47 is aligned with the identification zone 24. D4 is 29 mm for example.

Figure 8:
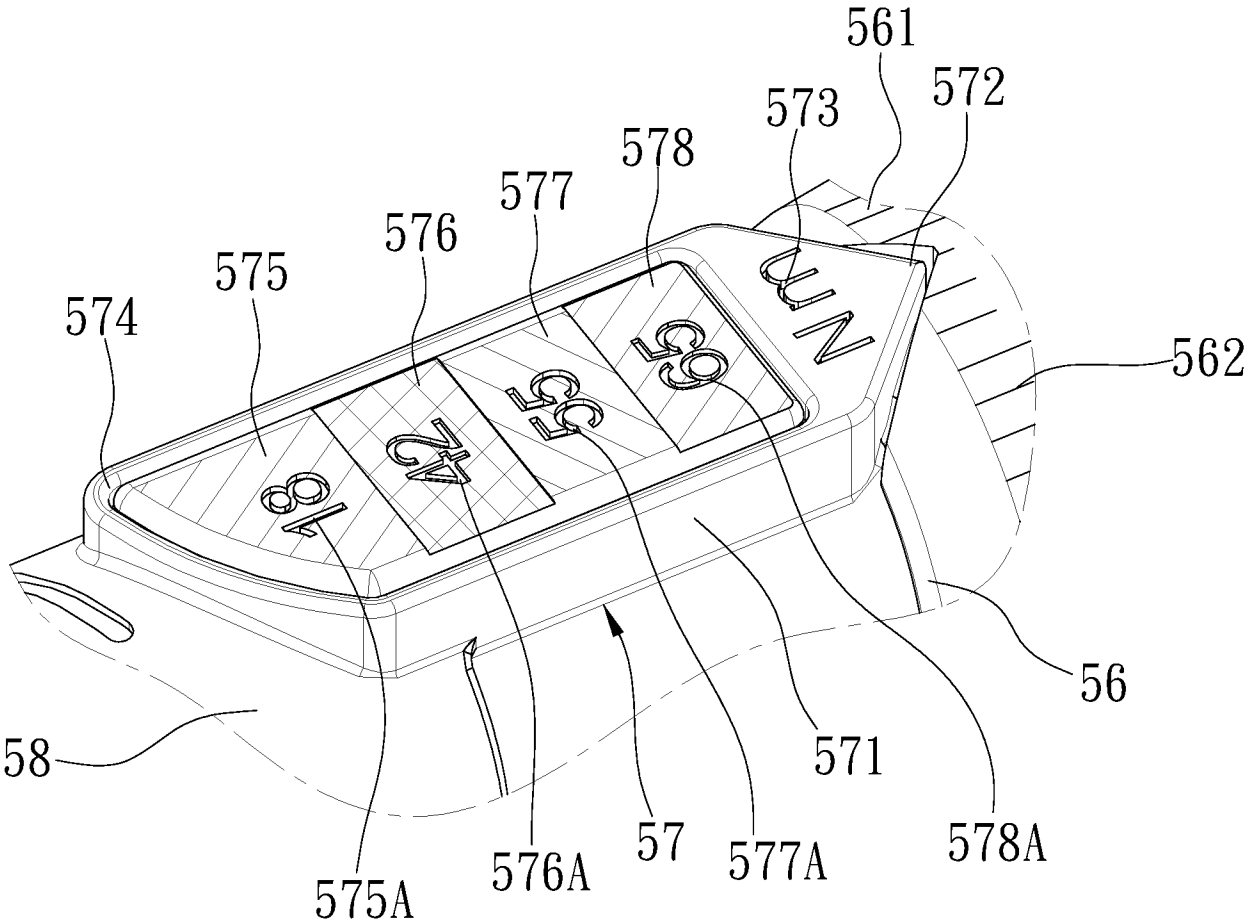
FIG. 8 is an enlarged partial view of the handle shown in FIG. 7.

Referring to FIGS. 7 and 8, the handle 51 includes a shank 52, a joint 53 formed at a front end of the shank 52, and a grip 55 formed at a rear end of the shank 52. A collar 58 is located on the shank 52.

The insert 19 is inserted in the joint 53. The rear end 18 of the bit 10 avoids excessive insertion of the insert 19 in the joint 53. The ball 20, which is located on the insert 19, abuts against a first portion of the button 54 inserted in the joint 53 so that a second portion of the button 54 extends from the joint 53. The button 54 can be pushed by the second portion so that the ball 20 is completely inserted in the insert 19 by the first portion of the button 54. Thus, the insert 19 can be disengaged from the joint 53.

A torque-indicating unit 57 includes a frame 571, four colored regions 575, 576, 577 and 578, and a lens 574. The frame 571 is formed on the collar 58. The colored regions 575, 576, 577 and 578 are located in the frame 571. The colored regions 575, 576, 577 and 578 are given corresponding to the identification zones 24, 25, 26 and 27. The colored region 575 carries a number 575A that represents a value of torque. The colored region 576 carries a first number 576A that represents a second value of torque. The four colored region 577 carries a number 577A that represents a third value of torque. The colored region 578 carries a number 578A that represents a fourth value of torque. The lens 574 is supported on the frame 571 so that the lens 574 extends over the colored regions 575, 576, 577 and 578. The frame 571 is formed with a pointed portion 572. A unit of torque 573 is printed on the frame 571, near the pointed portion 572. The unit of torque 573 is "Nm" for example.

Preferably, the handle 51 is equipped with a torque-adjusting mechanism operable to adjust a maximum value of torque to be exerted on a workpiece via the adjustable wrench 50. The torque-adjusting mechanism includes a scale unit 56 including a lens 561 and a scale ring 562. The scale ring 562 is rotated relative to the pointed portion 572 when the torque-adjusting mechanism is operated. Thus, the pointed portion 572 is pointed at a value of torque shown on the scale ring 562. The lens 561 protectively covers the scale ring 562. The torque-adjusting mechanism will not be described in detail for not being the spirit of the present invention.

Referring to FIG. 9, for example, the adjustable wrench 50 and an open-ended wrench 60 are used on an air conditioner 70. In specific, the wrenches 50 and 60 are used together to connect a pipe 71 of the air conditioner 70 to another pipe 77. To this end, a joint 72 is rotationally supported on the pipe 71, and the pipe 77 includes a threaded section 75 and a nut 76.

The open-ended wrench 60 includes a handle 61, a head 62 formed at an end of the handle 61, and two stationary jaws 63 extending from the head 62. Each of the stationary jaws 63 includes a contact face 64 so that the contact faces 64 are pointed at each other. The distance between the contact faces 64 is constant.

The joint 72 includes six facets 73. At least one of the facets 73 is provided with a colored layer 74. The colored layer 74 is identical or similar to the colored layer 24A, 25A, 26A or 27A. According to the color of the colored layer 74, the helical portion 36 is rotated to translate the movable jaw 40 to align the pointer 47 with the colored layer 24A, 25A, 26A or 27A of which the color is identical or similar to the color of the colored layer 74. Thus, the distance between the contact faces 13 and 41 is easily set at D1, D2, D3 or D4 corresponding to the size of the joint 72. Thus, the adjustable wrench 50 can be used to rotate the joint 72.

Moreover, the colored layer 74 is identical or similar to the colored region 575, 576, 577 or 578. According to the number 575A, 576A, 577A or 578A, the torque-adjusting mechanism is used to set the maximum value of torque that can be transferred through the handle 51. To this end, the scale ring 562 is rotated about the shank 52 to align a desired value with the pointed portion 572 of the frame 571.

The jaws 63 of the open-ended wrench 60 are engaged with only the nut 76 made in a size. The jaws 12 and 40 of the adjustable wrench 50 are engaged with the joint 72. Then, the adjustable wrench 50 is used to rotate the joint 72 on the threaded section 75 of the pipe 77 while the open-ended wrench 60 is used to keep the pipe 77 in position.

As described above, the adjustable wrench 50 exhibits several advantages as follows:

Firstly, the bit 10 is detachable from the handle 51 to allow another bit to be used with the handle 51. Thus, the adjustable wrench 50 can be used to rotate a wide range of workpieces.

Secondly, there is no need to memorize or calculate the relation of the size of a workpiece to the distance between the contact face 13 and 41 since the colored layer 74 is identical or similar to the color of the colored layer 24A, 25A, 26A or 27A. All it takes is to align the identification zone 24, 25, 26 or 27 to the pointer 47, and the distance between the contact faces 13 and 41 is substantially identical to the size of the workpiece.

Thirdly, there is no need to memorize or calculate a proper value of torque to be exerted on a workpiece corresponding to the size of the workpiece because the identification zone 24, 25, 26 or 27 clearly point out that value of torque. All it takes is to read the value on the identification zone 24, 25, 26 or 27 and accordingly use the torque-adjusting mechanism to set the value of torque.

Referring to FIG. 10, there is shown a bit 10' according to a second embodiment of the present invention. The bit 10' is like the bit 10 except for two things. Firstly, additional identification zones 24, 25, 26 and 27 are provided on the side 231 of the bit 10'. That is, the bit 10' includes two groups of identification zones 24, 25, 26 and 27. Secondly, an additional pointer 47 is provided on the side 461 of the movable jaw 40 of the bit 10'. That is, the bit 10' includes two pointers 47.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A bit of an adjustable wrench comprising:

a body comprising a front end and a stationary jaw extending from the front end;

a movable jaw movably connected to the front end of the body so that a distance between the jaws is adjustable;

multiple identification zones formed on a side of the body, wherein each of the identification zones is in a color corresponding to a size of a workpiece; and a pointer formed on a side of the movable jaw, wherein the distance between the jaws is set to be a value corresponding to the size of the workpiece when the pointer is aligned with one of the identification zones.

2. The bit according to claim 1, wherein the bit comprises four identification zones.

3. The bit according to claim 2, wherein a relationship between the identification zone, the size of the workpieces and the value of torque is determined according to a table as follows:

| IDENTIFICATION ZONE | SIZE OF WORKPIECE (MM) | VALUE OF TORQUE (NM) |
|---|---|---|
| FIRST IDENTIFICATION ZONE | 17 | 18 |
| SECOND IDENTIFICATION ZONE | 22 | 42 |
| THIRD IDENTIFICATION ZONE | 26 | 55 |
| FOURTH IDENTIFICATION ZONE 27 | 29 | 65. |

4. The bit according to claim 1, wherein each of the identification zones comprises a first portion in the form of a line and a second portion in the form of a circle, wherein the first portion of each of the identification zones extends to the front end of the body.

5. The bit according to claim 4, wherein each of the identification zones comprises a recess made in the side of the body and a colored layer filled in the recess.

6. The bit according to claim 5, wherein the recess of each of the identification zones comprises a first portion in the form of a narrow groove and a second portion in the form of a circular bore, wherein the first portion of each of the identification zones extends to the front end of the body.

7. The bit according to claim 6, wherein the first portion of each of the identification zones is a rectilinear line.

8. The bit according to claim 6, wherein the first portion of each of the identification zones is a bent line.

9. The bit according to claim 1, wherein the pointer comprises a triangular recess made in a side of the movable jaw and a colored layer filled in the triangular recess.

10. The bit according to claim 9, wherein the triangle recess is in the form of an equilateral triangle.

11. The bit according to claim 9, wherein the triangle recess is in the form of an isosceles triangle.

* * * * *